US007832606B2

(12) United States Patent
Sin

(10) Patent No.: US 7,832,606 B2
(45) Date of Patent: Nov. 16, 2010

(54) BELT CLIP FOR DETACHABLY FIXING CELLULAR PHONE

(75) Inventor: Ki Sub Sin, Seoul (KR)

(73) Assignee: Newvit Co., Ltd., Seoul (KR)

( * ) Notice: Subject to any disclaimer, the term of this patent is extended or adjusted under 35 U.S.C. 154(b) by 577 days.

(21) Appl. No.: 11/879,701

(22) Filed: Jul. 18, 2007

(65) Prior Publication Data

US 2008/0237282 A1 Oct. 2, 2008

(30) Foreign Application Priority Data

Mar. 30, 2007 (KR) ..... 10-2007-0031429

(51) Int. Cl.
*A01K 97/04* (2006.01)
*A45C 1/04* (2006.01)

(52) U.S. Cl. ..... 224/197; 224/665; 224/663; 224/930; 224/272; 24/3.11; 24/3.12

(58) Field of Classification Search ..... 224/197, 224/199, 663, 665, 930, 272, 668, 673, 680; 248/220.1, 220.21, 221.11, 221.12, 222.11, 248/223.41, 222.41, 225.11; 24/3.11, 3.12, 24/522, 526, 529, 570, 594.1, 598.1, 598.4
See application file for complete search history.

(56) References Cited

U.S. PATENT DOCUMENTS 5,375,749 A * 12/1994 Oliva ..... 224/271
5,597,102 A * 1/1997 Saarikko et al. ..... 224/197
5,850,996 A * 12/1998 Liang ..... 248/221.11
6,193,119 B1 * 2/2001 Schwarm ..... 224/197
6,233,788 B1 * 5/2001 Choy et al. ..... 24/3.12
6,520,863 B2 * 2/2003 Porper ..... 473/35
6,722,539 B2 * 4/2004 Iitsuka ..... 224/197
6,981,623 B2 * 1/2006 Iitsuka ..... 224/197
7,409,237 B2 * 8/2008 Tages ..... 455/575.1
2003/0085244 A1 * 5/2003 Parsons ..... 224/197

* cited by examiner

*Primary Examiner*—Nathan J Newhouse
*Assistant Examiner*—Peter Helvey
(74) *Attorney, Agent, or Firm*—Ladas & Parry LLP

(57) ABSTRACT

A belt clip for detachably fixing a cellular phone is disclosed, which comprises a body which has an accommodating part provided in the interior of the same and having an opened upper side, and a guide groove provided at a front side of the same for guiding accommodating into the accommodating part; and at least one stopper which is integrally formed at an inner side of the body and has a certain elastic force for preventing an escape of the accommodated engaging protrusion. It is possible to easily and reliably engage and disengage the cellular phone or the cellular phone casing to/from the belt clip, and the construction is simple. Since springs are not used in the present invention as compared to the conventional art, the manufacturing cost is not high, and a reliable and cheap belt clip for cellular phone can be manufactured.

3 Claims, 4 Drawing Sheets

BELT CLIP FOR DETACHABLY FIXING CELLULAR PHONE

BACKGROUND OF THE INVENTION

1. Field of the Invention

The present invention relates to a belt clip for detachably fixing a cellular phone, and in particular to a belt clip for detachably fixing a cellular phone in which a cellular phone or a cellular phone casing is detachably fixed at a user's belt.

2. Description of the Background Art

In recent years, the number of cellular phone users sharply increases. Almost cellular phone users store the cellular phones in a backpack or a handbag. So, when someone calls, it is possible to easily take out and answer the phone. Many cellular phone users prefer to fix the cellular phone at a waist belt due to many conveniences.

In the case that a cellular phone is fixed at a waist belt, a belt clip is needed. The Korean utility model registration No. 20-0424288(Filed on Aug. 10, 2006) "Belt clip for fixing cellular phone" is disclosed. According to the above prior art, a fixing structure between a cellular phone or a cellular phone casing and a belt clip comprises an insertion opening which is integrally attached to a back surface of a cellular phone or a cellular phone casing, with a slide type insertion groove being formed at left and right ends of a center portion; a vertical concave part in which first and second slide rails are formed at left and right sides in a double structure so that a belt clip being opposite to the insertion opening is integrally engaged in such a way that a center portion of the insertion groove is inserted; an operation piece in which an intermediate part having a lower end bent forwards and formed by cutting one end of the concave part in a U shape is elastically supported with respect to a fixed center end; a plate which includes a protrusion rotation part which is integrally protruded from a spring groove formed on a concave part of an upper end of the operation piece and a back surface of the concave part of the plate; an operation groove which is supported by a first slide groove corresponding to an inner side of the concave part, with a bent lower end of the operation piece being inserted into the same and being protruded; a pusher which has a spring groove being opposite to the above spring groove; a plate spring which is disposed in the opposite groves, with its upper and lower ends being fixed in each groove; and a clip which can rotate at a certain angle in an inserted state so that a protrusion rotation part is not disengaged.

However, according to the conventional belt clip, the engagement between the cellular phone and the cellular phone casing may not be easily disengaged when it is needed to use the cellular phone. The numbers of the manufacturing processes and parts may increase owing to its complexity, so that manufacturing is very costly.

SUMMARY OF THE INVENTION

Accordingly, it is an object of the present invention to provide a belt clip for detachably fixing a cellular phone. In a belt clip in which a cellular phone or a cellular phone casing having an engaging protrusion is engaged, with a clip part being provided in the belt clip for being fixed at a waist belt of a user, a belt clip for detachably fixing a cellular phone comprises a body which has an accommodating part provided in the interior of the same and having an opened upper side, and a guide groove provided at a front side of the same for guiding accommodating the engaging protrusion into the accommodating part, and two stoppers that are integrally formed at an inner side of the body and has a certain elastic force for preventing an escape of the accommodated engaging protrusion.

To achieve the above objects, in a belt clip in which a cellular phone or a cellular phone casing having an engaging protrusion is engaged, with a clip part being provided in the belt clip for being fixed at a waist belt of a user, there is provided a belt clip for detachably fixing a cellular phone which comprises a body which has an accommodating part provided in the interior of the same and having an opened upper side, and a guide groove provided at a front side of the same for guiding accommodating the engaging protrusion into the accommodating part; and at least one stopper which is integrally formed at an inner side of the body and has a certain elastic force for preventing an escape of the accommodated engaging protrusion.

The stopper comprises a first cut-off part formed at a backside of the body, and an escape prevention protrusion formed from the first cut-off part to the front surface.

The escape prevention protrusion has a circularly protruded end portion.

The stopper comprises a second cut-off part formed at a backside of the body, and an escape prevention shoulder formed from the second cut-off part to the front surface.

The escape prevention shoulder has a circularly protruded cross section, and a slant guide part formed at an upper side for guiding the engaging protrusion.

The body comprises an opening formed at both sides of the same, and a side support member which is engaged with the opening.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

The preferred embodiments of the present invention will be described with reference to the accompanying drawings.

Figure 1:
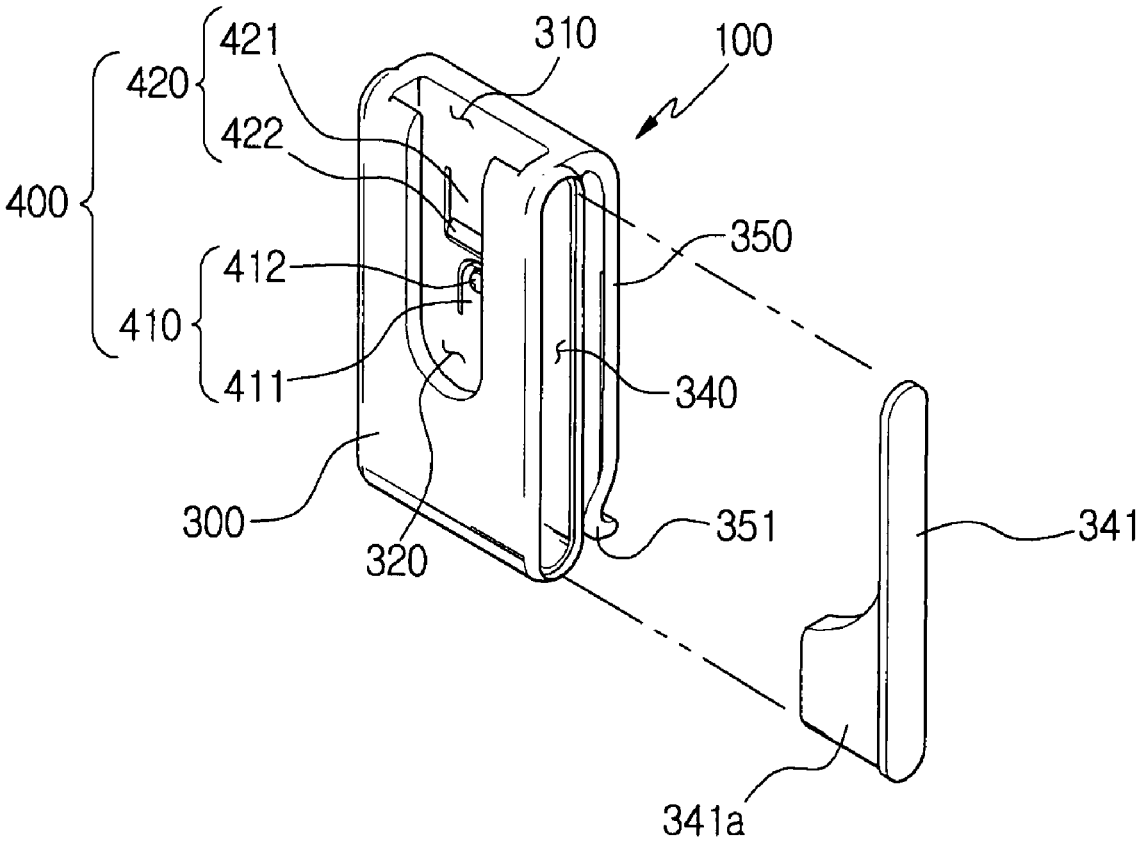
FIG. 1 is a perspective view illustrating an assembled structure of a belt clip for detachably fixing a cellular phone according to an embodiment of the present invention.

FIG. 1 is a perspective view illustrating an assembled structure of a belt clip for detachably fixing a cellular phone according to an embodiment of the present invention.

Figure 2:
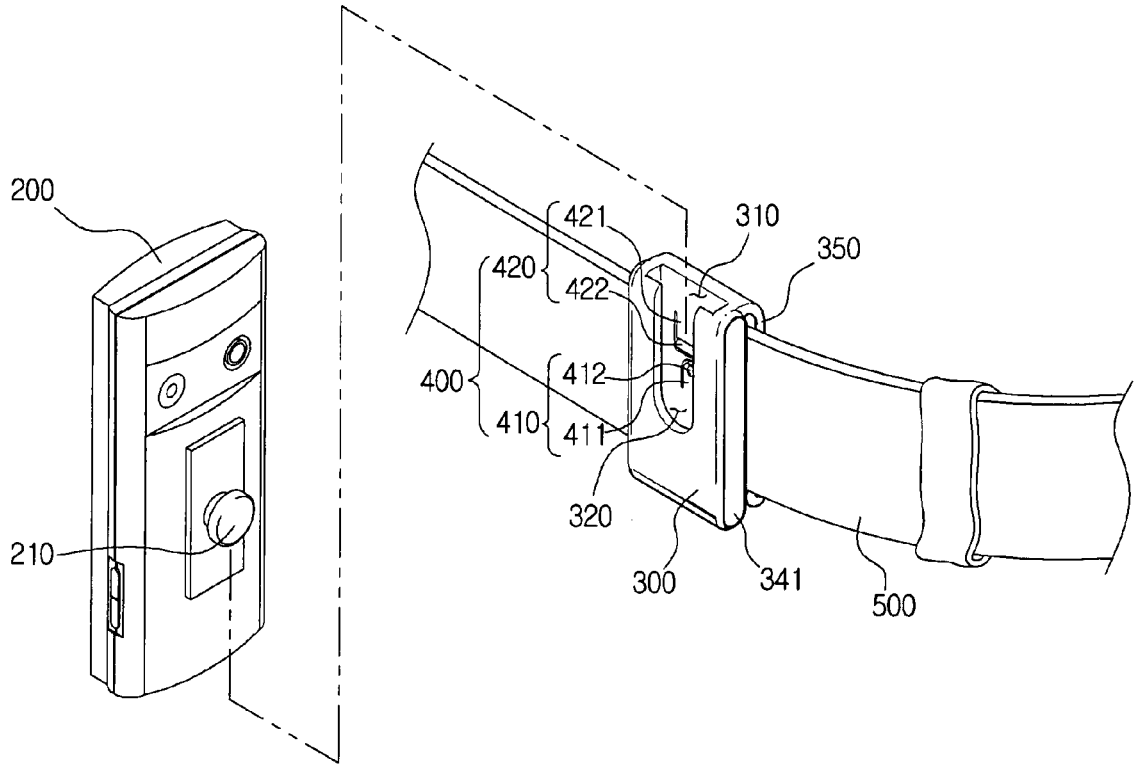
FIG. 2 is a view of a use state of a belt clip for detachably fixing a cellular phone according to an embodiment of the present invention.

FIG. 2 is a view of a use state of a belt clip for detachably fixing a cellular phone according to an embodiment of the present invention.

Figure 3A:
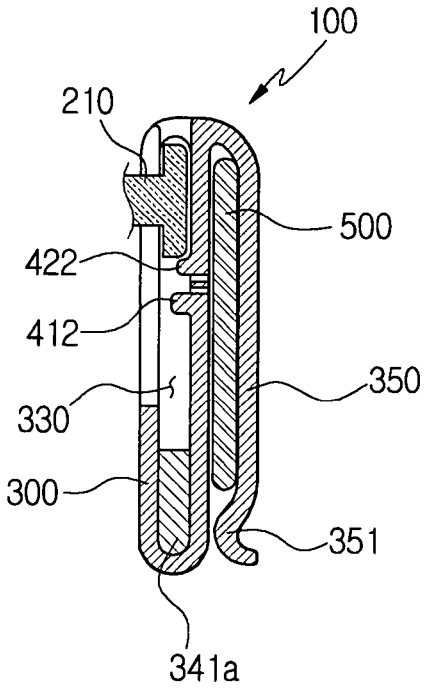
FIGS. 3A and 3B are cross sectional views illustrating a state before a cellular phone is detachably fixed at a belt clip according to an embodiment of the present invention.
Figure 3B:
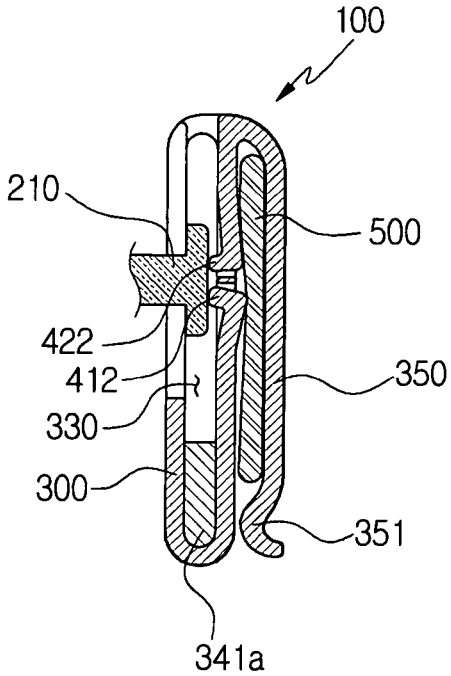
Figure 3C:
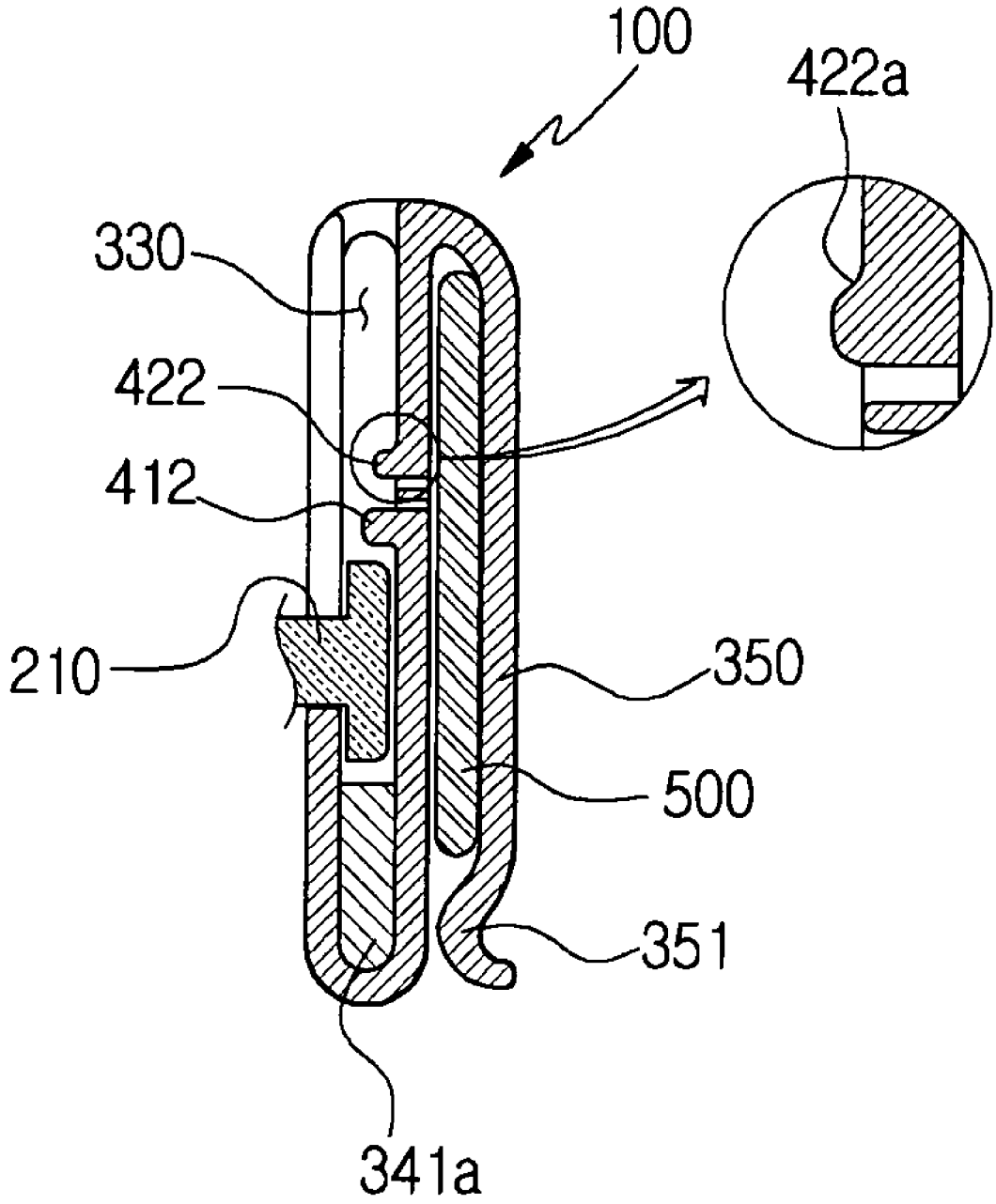
FIG. 3C is a cross sectional view illustrating a state after a cellular phone is detachably fixed at a belt clip according to an embodiment of the present invention.

FIGS. 3A and 3B are cross sectional views illustrating a state before a cellular phone is detachably fixed at a belt clip according to an embodiment of the present invention. FIG. 3C is a cross sectional view illustrating a state after a cellular phone is detachably fixed at a belt clip according to an embodiment of the present invention.

As shown in FIGS. 1 through 3C, a belt clip for detachably fixing a cellular phone according to an embodiment of the present invention comprises a body 300 in which an engaging protrusion 210 provided at one side of a cellular phone 200 is inserted into the same, and a stopper 400 which is integrally provided at an inner side of the body 300 and has a certain elastic force.

The engaging protrusion 210 is formed in a circular plate shape as an end of the protrusion is expanded.

The body 300 has an insertion opening 310 which receives the engaging protrusion 210, a guide groove 320 which guides the engaging protrusion 210 extended from the insertion opening 310, and an accommodating part 330 which is formed at the interior for accommodating the engaging protrusion 210.

It is preferred that the width of the guide groove 320 is less than the diameter of the end of the engaging protrusion 210 so that the engaging protrusion 210 is not escaped from the body 300 through the guide groove 320. The upper side of the accommodating part 330 is opened by means of the insertion opening 310.

A stopper 400 is provided in the interior of the body 300 so that the engaging protrusion 210 is not escaped to the outside through the insertion opening 310.

As shown in FIGS. 1 through 3C, the stopper 400 comprises a first stopper 410 and a second stopper 420.

Here, the first stopper 410 comprises a first cut-off part 411 formed in such a way that a panel of a back side of the body 300 is cut off in an inverted U shape, and an escape prevention protrusion 412 which is formed in a forward direction at a center of the upper end which is cut off in a curve shape.

The escape prevention protrusion 412 preferably has a circularly protruded end portion so that when a user applies force to the engaging protrusion 210, the engaging protrusion 210 slides up and down in the accommodating part 330 along the guide groove 320 over the escape prevention protrusion 412.

The inserted engaging protrusion 210 is positioned at the lower side of the body 300 via the escape prevention protrusion 412, and the upper surface of the engaging protrusion 210 is supported by means of the lower side of the escape prevention protrusion 412, and the lower side of the engaging protrusion 210 is supported by means of the lower surface of the guide groove 320, so that the engaging protrusion 210 is stably fixed at the body 300.

A second stopper 420 is provided at an upper side of the first stopper 410.

The second stopper 420 comprises a second cut-off part 421 formed in such a way that a panel of a back side of the body 300 is cut off in a U shape, and an escape prevention shoulder 422 which is formed in a forward direction and is extended from a lower end of the second cut-off portion.

In case that the engaging protrusion 210 escapes from the escape prevention protrusion 412, the upper surface of the engaging protrusion 210 is engaged by means of the lower end of the escape prevention shoulder 422, so that the engaging protrusion 210 is prevented from being escaped from the body 300.

The escape prevention shoulder 422 preferably has a circularly protruded end portion so that when a user applies force to the engaging protrusion 210, the engaging protrusion 210 slides up and down in the accommodating part 330 along the guide groove 320 over the escape prevention shoulder 422. The above circularly protruded end portion of the escape prevention shoulder 422 is formed in a longitudinal direction of the body 300. In addition, a concave curved slant guide part 422*a* is preferably formed at an upper side of the escape prevention shoulder 422 for thereby guiding the up and down movements of the engaging protrusion 210.

As shown in FIG. 3B, when a user applies force to the escape prevention protrusion 412 or the escape prevention shoulder 422, the engaging protrusion 210 moves up and down over the escape prevention protrusion 412 or the escape prevention shoulder 422. Here, the first and second cut-off parts 411 and 421 are forced to rotate and slightly move back, and then are forced to return its original position with elastic force after the engaging protrusion 210 passes through the escape prevention shoulder 422.

An opening 340 is formed at both sides of the body 300, and a side support member 341 having a step part 341*a* is inserted into the opening 340 for thereby making the outer look better.

A clip part 350 is provided at a back surface of the body 300. The clip part 350 is formed in a plate shape and is bent at an upper backside of the body 300 and is extended in a downward direction.

A belt fixture 351 is provided at a lower side of the clip part 350. It is preferred that the belt fixture 351 is formed in such a way that a lower end of the clip part 350 is bent in a back side direction of the body 300 and then is bent in the opposite direction. The belt fixture 351 allows the belt clip 100 not to separate from the waist belt 500.

Here, the body 300 and the clip part 350 are preferably made of the same materials such as aluminum, stainless steel, etc. They may be more preferably made of cheap synthetic resin.

The operation of the belt clip for detachably fixing a cellular phone according to an embodiment of the present invention will be described.

As shown in FIG. 2, the clip part 350 of the belt clip 100 is inserted from the upper side to the lower side of the waist belt so that the waist belt 500 of a user is disposed between the clip part 350 of the belt clip 100 and the body 300, and the guide groove 320 of the front side of the body 300 is exposed to the outside.

As shown in FIGS. 3A through 3C, the engaging protrusion 210 provided at the back side of the cellular phone 200 is inserted into the insertion opening 310 formed at the upper side of the body 300 of the belt clip 100. The cellular phone 200 is forced to move in the downward direction of the body 300 of the belt clip 100, so that the engaging protrusion 210 slides and is inserted into the accommodating part of the interior of the body 300 along the guide groove 320.

Here, the engaging protrusion 210 moves via the slant guide part 422*a* over the escape prevention shoulder 422, and the second cut-off part 421 is forced to rotate with respect to the non cut-off portion of the upper side and is forced to slightly move back and is forced to return to its original position after the engaging protrusion 210 passes through the escape prevention shoulder 422.

The engaging protrusion 210 moves over the escape prevention protrusion 412, and the first cut-off part 411 is forced to rotate with respect to the non cut-off portion of the lower side and is forced to slightly move back and then is forced to return to its original position after the engaging protrusion 210 passes through the escape prevention protrusion 412.

The engaging protrusion 210, which was slid along the guide groove 320, is supported by means of the lower surface of the guide groove 320, so that the body 300 does not move in the downward direction, and the upper surface of the engaging protrusion 210 is supported by means of the lower side of the escape prevention protrusion 412, so that it does not move in the upward direction.

In case that the engaging protrusion 210 escapes from the fixed position via the escape prevention protrusion 412, the escape of the engaging protrusion 210 is stopped by means of the escape prevention shoulder 422 formed at the upper side of the escape prevention protrusion 412, so that it is possible to prevent an unexpected escape of the cellular phone 200 from the belt clip 100.

In case that the cellular phone 200 is considered to separate from the belt clip 100, the cellular phone 200 is forced to move in the upward direction of the body 300 of the belt clip 100, so that the engaging protrusion 210 is escaped from the belt clip 100 through the insertion opening 310 via the escape prevention protrusion 412 and the escape prevention shoulder 422, sequentially. So, the cellular phone 200 is separated from the belt clip 100.

FIG. 2 is a view illustrating a state that the cellular phone 200 is engaged at the belt clip 100. The above construction is not limited thereto. Namely, in another embodiment of the present invention, the cellular phone casing having the engaging protrusion 210 at one side may be engaged at the belt clip 100 in the same manner.

As described above, according to the belt clip for detachably fixing the cellular phone according to an embodiment of the present invention, it is possible to easily and reliably engage and disengage the cellular phone or the cellular phone casing to/from the belt clip, and the construction is simple. Since springs are not used in the present invention as compared to the conventional art, the manufacturing cost is not high, and a reliable and cheap belt clip for cellular phone can be manufactured.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A belt clip for detachably securing an engaging protrusion of a cellular phone or a cellular phone casing, said belt clip comprising:

a clip part for securing the belt clip to a waist belt of a user;

a body connected to said clip part, said body defining an accommodating part in an interior of the body and having an opened upper side, and a guide groove at a front side of the body for guiding and accommodating the engaging protrusion of the cellular phone or the celluar phone casing into the accommodating part; and a first stopper and a second stopper each integrally formed on an inner surface which of the body and provide an elastic force to prevent the engaging protrusion from escaping the accommodating part when the engaging protrusion is accommodated inside the accomodating part;

wherein said first stopper comprises an inverted U-shaped first cut-off part formed at a back side of the body, and an escape prevention protrusion extending from the first cut-off part toward the front side of the body, wherein said escape prevention protrusion has a circularly protruded end portion, wherein said second stopper is arranged above an upper side of the first stopper and comprises a U-shaped second cut-off part formed at the back side of the body, and an escape prevention shoulder extending from the second cut-off part toward the front side of the body.

2. The belt clip for detachably fixing a cellular phone of claim 1, wherein said escape prevention shoulder has a circularly protruded cross section, and a slant guide part formed at an upper side for guiding the engaging protrusion.

3. The belt clip for detachably fixing a cellular phone of claim 1, wherein said body further defines openings an opening on opposite sides of the body, and wherein the belt clip further comprises side support members that are engaged with the openings.

* * * * *